US008177417B2

(12) United States Patent
Ditzig et al.

(10) Patent No.: US 8,177,417 B2
(45) **Date of Patent: *May 15, 2012**

(54) APPARATUS FOR CONTINUOUS BLENDING

(75) Inventors: Joseph Ditzig, Bangor, PA (US); Thomas Chirkot, Swayersville, PA (US); Kiet C. Ly, Stroudsburg, PA (US)

(73) Assignee: Harsco Technologies Corporation, Fairmont, MN (US)

( * ) Notice: Subject to any disclaimer, the term of this patent is extended or adjusted under 35 U.S.C. 154(b) by 1087 days.

This patent is subject to a terminal disclaimer.

(21) Appl. No.: 12/054,110

(22) Filed: Mar. 24, 2008

(65) Prior Publication Data

US 2008/0212404 A1 Sep. 4, 2008

Related U.S. Application Data

(63) Continuation of application No. 11/113,492, filed on Apr. 25, 2005, now Pat. No. 7,347,613.

(51) Int. Cl.
*B01F 9/08* (2006.01)

(52) U.S. Cl. ..... 366/219; 366/224; 366/235; 366/323

(58) Field of Classification Search ..... 366/219, 366/224, 235, 323

See application file for complete search history.

(56) References Cited

U.S. PATENT DOCUMENTS 302,420 A * 7/1884 McKeage ..... 209/361
2,694,565 A * 11/1954 Sainderichin ..... 432/106
2,901,227 A * 8/1959 Russum ..... 366/235
3,138,367 A * 6/1964 Raether ..... 366/183.4
3,168,289 A * 2/1965 Voses ..... 366/220
3,188,058 A * 6/1965 Locke ..... 366/235
3,266,779 A * 8/1966 Fischer et al. ..... 366/170.1
3,272,444 A * 9/1966 Rich et al. ..... 241/176
3,341,182 A * 9/1967 Fischer ..... 366/183.4
3,362,688 A * 1/1968 Fischer ..... 366/170.1
3,371,913 A * 3/1968 Muench, Sr. ..... 366/220
3,380,671 A * 4/1968 Kubodera ..... 241/98
3,381,944 A * 5/1968 Clary ..... 366/220
3,388,893 A * 6/1968 Hall ..... 366/135
3,397,067 A * 8/1968 Galle ..... 426/622
3,635,443 A * 1/1972 Fischer ..... 366/173.2
3,787,035 A * 1/1974 Bryson et al. ..... 366/170.1
4,075,356 A * 2/1978 Haag et al. ..... 426/285
4,141,657 A * 2/1979 Fischer ..... 366/232
4,199,153 A * 4/1980 Martin ..... 366/139
4,282,101 A * 8/1981 Takacs et al. ..... 210/403
4,296,072 A * 10/1981 Takacs et al. ..... 422/254
4,368,986 A * 1/1983 Fischer ..... 366/170.1
4,435,182 A * 3/1984 Banos et al. ..... 23/295 R
7,347,613 B2 * 3/2008 Ditzig et al. ..... 366/219

* cited by examiner

*Primary Examiner* — Tony G Soohoo
(74) *Attorney, Agent, or Firm* — McNees Wallace & Nurick LLC

(57) ABSTRACT

The present invention provides a continuous blender having a drive unit assembly with a shell assembly mounting assembly and a shell assembly structured to be removably coupled to the shell assembly mounting assembly by one or more clamps. The drive unit assembly may be coupled to shell assemblies having different lengths and diameters. Thus, by changing the shell assembly coupled to the drive unit assembly, the output of the continuous blender may be dramatically changed.

14 Claims, 8 Drawing Sheets

APPARATUS FOR CONTINUOUS BLENDING

CROSS-REFERENCE TO RELATED APPLICATION

The present application claims priority from and claims the benefit of U.S. patent application Ser. No. 11/113,492 filed Apr. 25, 2005, the disclosure of which is incorporated herein by reference.

BACKGROUND OF THE INVENTION

1. Field of the Invention

This application relates to an apparatus for continuous blending and, more specifically, to a continuous blender that is adaptable to produce different output rates.

2. Background Information

Continuous blenders are known in the prior art, see e.g., U.S. Pat. No. 3,341,182. Such blenders included an inlet chute, an initial mixing chamber and a zig-zag mixing tube with an outlet. The inlet chute had an opening into the mixing chamber. The mixing chamber had an outlet to the mixing tube. Generally, two or more, preferably dry, materials were introduced into the continuous blender via the inlet chute. The mixing chamber and the mixing tube were then rotated in order to mix the materials. The zig-zag tube was made from a series of V-shaped and inverted V-shaped sections. Thus, when the lateral axis of the zig-zag tube was in a vertical plane, the zig-zag tube had a series of peaks and valleys, with each vertex of a V-shaped or inverted V-shaped section being that peak or valley. As the zig-zag tube was rotated, the peaks and valleys were inverted.

In operation, the dry materials were introduced into the mixing chamber via the inlet chute. As the mixing chamber was rotated, the materials were partially mixed therein. When the zig-zag tube V-shaped section adjacent to the initial mixing chamber moved to a position wherein the vertex was below the mixing chamber outlet, a quantity of the partially mixed materials fell into the first V-shaped section. As the first V-shaped section was rotated and inverted, the materials fell onto the inverted vertex and a portion of the materials moved into the next V-shaped section, while another portion was returned to the initial mixing chamber. As the zig-zag tube continued to rotate, the process of a portion of mixed materials moving to the next section of the tube while another portion moved backward was repeated, thereby thoroughly mixing the materials. Eventually, a portion of the mix materials reached the zig-zag tube outlet and were discharged.

The initial mixing chamber and zig-zag tube are coupled together, or are formed from a unitary piece, and are called the shell assembly. The shell assembly was supported at least at both ends by trunnion rims having a generally circular outer edge and a disk having an opening therein. The trunnion rim opening was typically off-center. The zig-zag tube extended through the trunnion rim opening. The trunnion rims were disposed on casters attached to a mounting plate. An additional trunnion rim was coupled to a motor, typically by a chain drive. When the motor was operated, the chain drive caused the shell assembly to rotate about its longitudinal axis. The input tube was rigidly coupled to the mounting plate to ensure the inlet chute did not rotate with the shell assembly. A seal was located at the interface between the inlet chute and the shell assembly. It is further noted that the mounting plate included a tilting device whereby the shell assembly and input tube could be tilted.

In this configuration, the throughput of the continuous blender was controlled by three main factors; the size of the zig-zag tube (both diameter and length), the speed of the motor, and the degree of tilt of the mounting plate. The size of the zig-zag tube was fixed and could not be changed. Although the speed of the motor was adjustable, the range of motor speeds was still controlled by factors such as, but not limited to, the diameter of the shell assembly and centrifugal forces. The degree of tilt could be increased, that is the discharge end or the zig-zag tube could be lowered, or decreased, i.e. the discharge end could be raised. Of these factors, the size of the zig-zag tube had the greatest impact on the amount of material that could be blended and, as noted above, this was not adjustable. As such, the prior art continuous blenders were not very adaptable to different mixing requirements.

This type of continuous blending was improved by adding an "intensifier." The intensifier was, essentially, a blender inserted into the initial mixing chamber. The intensifier included a shaft with a blade or paddle at the end. The shaft was disposed parallel to the longitudinal axis of the shell assembly and the paddles were located in the mixing chamber. The shaft included seals to reduce the amount of mixed materials from escaping. An additional chain from the motor acted to impart rotational movement to the intensifier shaft. As the intensifier shaft had a smaller diameter than the shell assembly, the intensifier shaft rotated at a greater speed. The disadvantage of adding the intensifier was that the intensifier shaft housing was typically disposed in the path of the inlet chute and could cause the materials to become "hung up." This was especially a problem where there was a very little amount of one material and any delay in introducing that material to the mix could cause uneven mixing. Thus, even the improved continuous blender was not overly adaptable to different mixing routines.

Also, as noted above, various interfaces between the shell assembly and other components, e.g., the inlet chute and the intensifier shaft included seals to reduce the quantity of mix material that escaped. Not only were these seals subject to wear and failure caused by normal use, but were also subject to additional wear on the trunnion rims and the casters. That is, as the trunnion rims and casters would wear, the shell assembly would not rotate about the designed rotational centerline. In this condition, the wear on the trunnion rims and casters would create non-parallel sealing surfaces thereby creating gaps. The gaps at the sealing surfaces allowed the product to leak.

U.S. patent application Ser. No. 11/113,492 (hereinafter '492 application), from which the present application partially depends, provides a continuous blender having a drive unit with a shell assembly mounting and a shell assembly structured to be removably coupled to the shell assembly mounting by one or more clamps. The drive unit may be coupled to shell assemblies having different lengths and diameters. Thus, by changing the shell assembly coupled to the drive unit, the output of the continuous blender may be dramatically changed.

The continuous blender also includes an intensifier with a separate drive motor. The shell assembly motor and the intensifier motor are independent of each other. Moreover, both the shell assembly motor and the intensifier motor may be run intermittently, at various speed, and in reverse. In such configuration, the mixing capabilities of the continuous blender are highly adjustable. The speed of the shell assembly motor and the intensifier motor, as well as an adjustable tilting mechanism, are controlled by a programmable control unit. The control unit may be programmed with various parameters associated with selected formulations. As such, the continuous blender may be quickly switched from one formulation to another. In addition, for a given formulation the controls allow for real time adjustment to maintain the formulation within acceptable limits. The system also utilizes Process Analytical Technology to provide a feedback loop.

The '492 application also provides for a continuous blender wherein the zig-zag tube is cantilevered. That is, the zig-zag tube is not supported by trunnion rims. As such, there are fewer components subject to wear and tear. Additionally, the '492 application provides for an air purged seal with a spherical surface between the drive unit and the shell assembly. Such an air purged seal with a spherical surface is useful in maintaining a controlled seal interface in preventing product leakage on a drive unit assembly with a cantilevered shell assembly.

As use of a cantilevered shell assembly allows for rapid changing of a shell assembly, a kit as described herein may be provided having two or more shell assemblies having different throughput rates.

SUMMARY OF THE INVENTION

The present invention provides a kit for use with an adjustable continuous blender in blending a product, the continuous blender comprising: a drive unit assembly having a shell assembly plate structured to be coupled to a shell assembly; at least one clamp structured to removably couple the shell assembly to the drive unit assembly; and wherein the shell assembly is temporarily coupled to the drive unit assembly by the at least one clamp. The kit comprising: a first shell assembly having a first throughput; and a second shell assembly having a second throughput, wherein the second throughput is different from the first throughput, and wherein each shell assembly is structured to be removably coupled to the drive unit assembly.

For a product having a specific gravity or about 0.5 to 0.6, the first throughput may be one of generally between 5 kg/hour and 30 kg/hour, 30 kg/hour and 90 kg/hour, or 90 kg/hour and 150 kg/hour. Additionally, for a product having a specific gravity or about 0.5 to 0.6, the second throughput may be one of generally between 5 kg/hour and 30 kg/hour, 30 kg/hour and 90 kg/hour, or 90 kg/hour and 150 kg/hour.

The kit may further comprise a third shell assembly having a third throughput, wherein the third throughput is different from the first throughput and the second throughput.

The present invention also provides a method of operating a continuous blender for blending a product, the continuous blender comprising a drive unit assembly having a shell assembly plate structured to be coupled to a shell assembly; at least one shell assembly structured to be removably coupled to the drive unit assembly, the shell assembly having an intensifier chamber and a cantilever zig-zag tubular member; at least one clamp structured to removably couple the shell assembly to the drive unit assembly; and wherein said shell assembly is temporarily coupled to the drive unit assembly by the at least one clamp. The method comprising: operating the continuous blender with a first shell assembly having a first throughput; removing the first shell assembly; installing a second shell assembly having a second throughput different from the first throughput; and operating the continuous blender with the second shell assembly. The method may further comprise: removing the second shell assembly; installing a third shell assembly having a third throughput different from the first throughput and said second throughput; and operating the continuous blender with the third shell assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners are easily separated whereas two components that are welded together are not easily separated.

Figure 1:
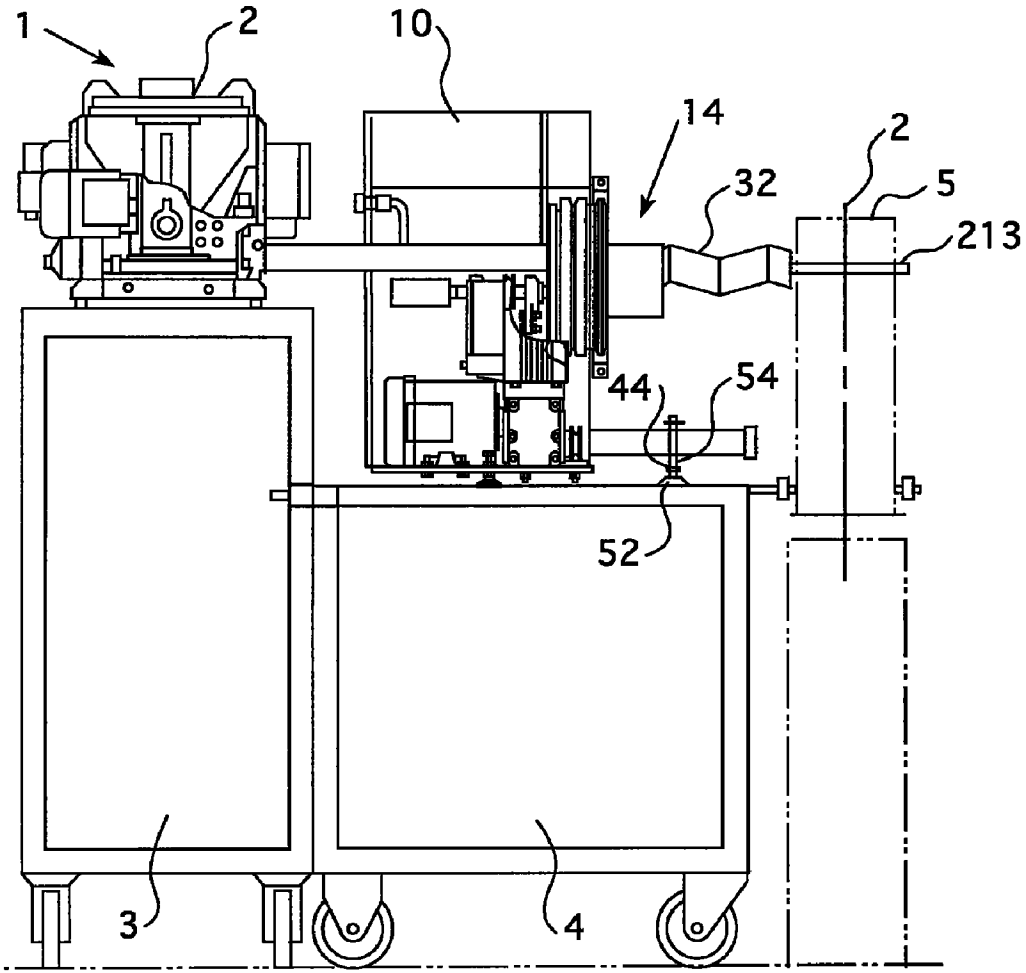
FIG. 1 is a side view of a continuous blender in accordance with an embodiment of the present invention.

As shown in FIG. 1, a metered continuous blender 1 includes one or more metering devices 2, and a continuous blender 10. The components of the metered continuous blender 1 may be mounted on separate movable platforms 3, 4, thereby allowing the continuous blender 10 to be coupled to different metering devices 2. The metering devices 2 are structured to repeatedly eject a measured amount of a powdered material. The metering devices 2 are typically coupled to an input tube 24 (described below) on the continuous blender 10. The metering devices 2 may also include an end metering device 5 structured to repeatedly eject a measured amount of a powdered material into the zig-zag tube 32 (described below) on the continuous blender 10.

Figure 4:
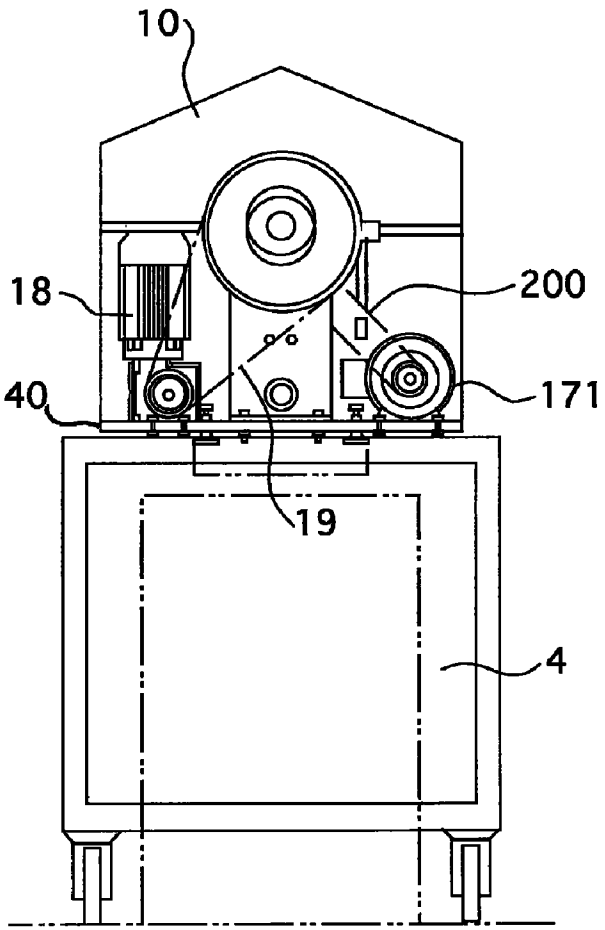
FIG. 4 is a front view of the continuous blender.
Figure 2:
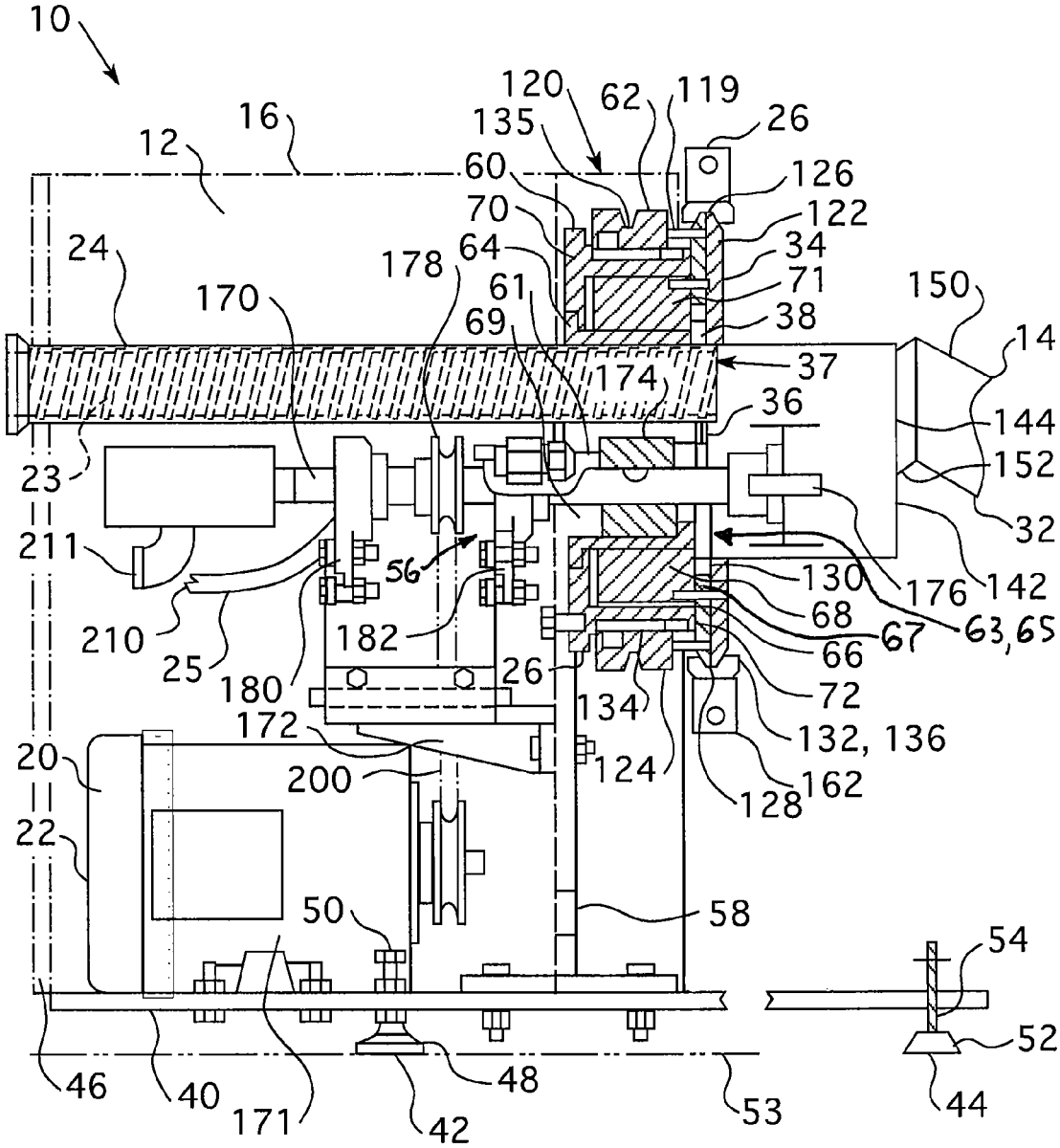
FIG. 2 is a partial cross-sectional side view of the continuous blender.
Figure 3:
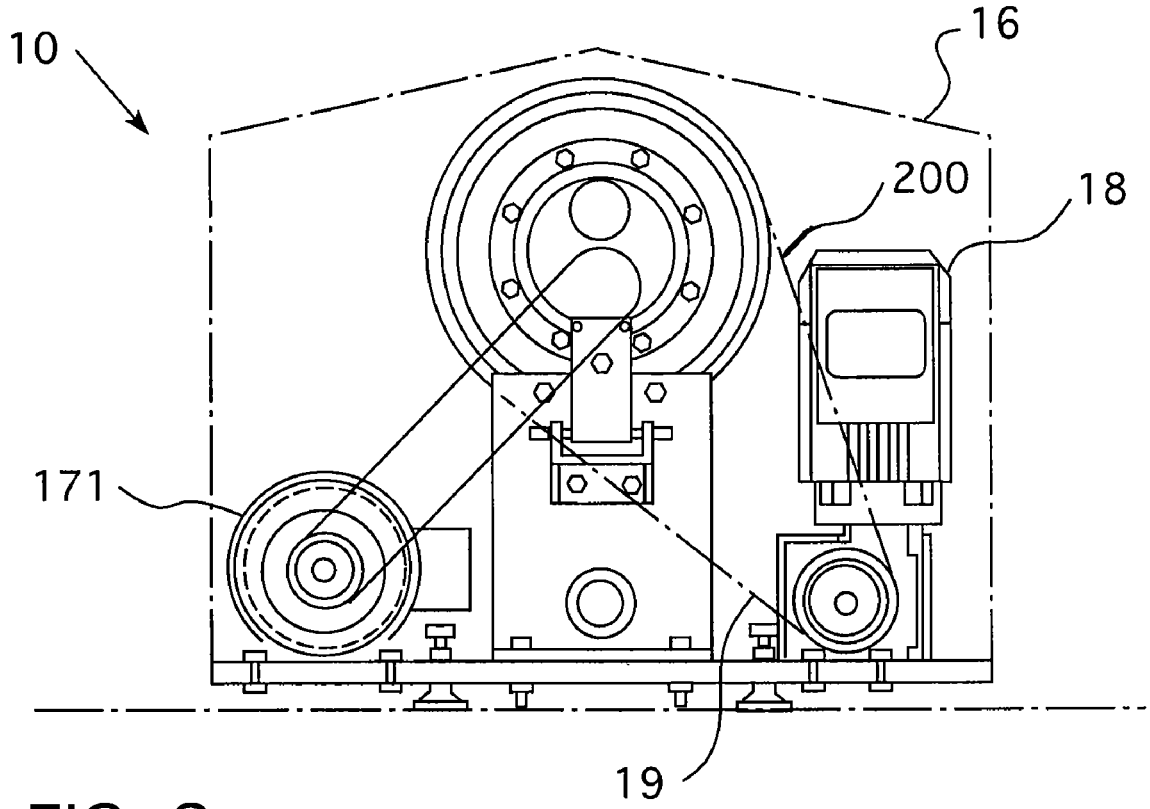
FIG. 3 is a back view of the continuous blender.
Figure 5:
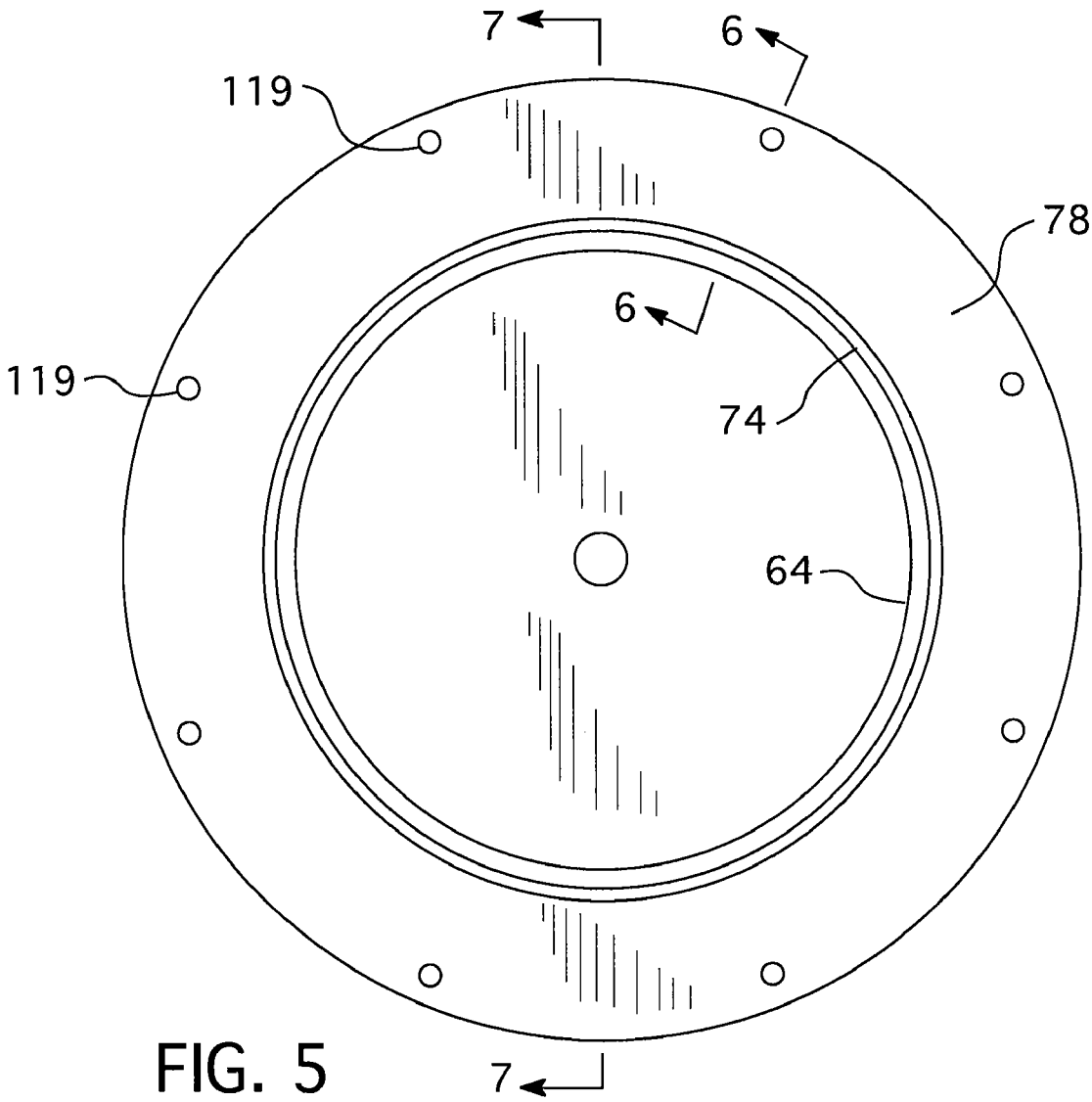
FIG. 5 is a front view of a bearing assembly.

As shown in FIG. 2, the continuous blender 10 includes a drive unit assembly 12 and a shell assembly 14. The drive unit assembly 12 includes a housing assembly 16, a shell motor 18 (shown in FIGS. 3 and 4), an intensifier assembly 20, a control device 22, an input tube 24, an air supply assembly 25, and a shell assembly mounting assembly 26. The shell assembly 14 includes an intensifier chamber 30, a zig-zag tube 32, and a drum plate 34.

The housing assembly 16 includes a mounting plate 40, at least one fixed mount 42, at least one adjustable mount 44, and an upper housing 46. The mounting plate 40 is a substantially rigid member. The fixed mount 42 includes a lower component 48 and an upper component 50. The fixed mount lower and upper components 48, 50 are structured to be rotatably coupled to each other. The fixed mount lower component 48 is fixed to a substrate, such as, but not limited to, a work table 53. The fixed mount upper component 50 is attached to the lower side of the mounting plate 40. The adjustable mount 44 also includes a lower component 52 and an upper component 54. The adjustable mount lower component 52 is fixed to a substrate, such as, but not limited to, a work table 53. The adjustable mount upper component 54 is structured to elongate. As shown, the adjustable mount upper component 54 is a threaded rod which passes through a threaded opening. The adjustable mount upper component 54 may, however, be any type of elongated structure that is actuated either manually or automatically.

The adjustable mount 44 is coupled to the lower side of the mounting plate 40 at a location that is spaced from the fixed mount 42. Thus, as the adjustable mount 44 is adjusted, the mounting plate 40 is tilted relative to a horizontal plane. The adjustable mount 44 may be controlled by the control device 22. The upper housing 46 is structured to enclose the various components of the drive unit assembly 12 and includes an opening 56 for the outer bearing 78, discussed below. The upper housing 46 also includes a vertical support 58 that extends upwardly from the mounting plate 40.

The shell assembly mounting assembly 26 is coupled to the vertical support 58. The shell assembly mounting assembly 26 includes a fixed base 60 and a rotating base 62. The fixed base 60 includes an inner collar 64 with an outer surface 66 and an outer collar 68 with an outer surface 70. The inner collar 64 includes an air supply tube opening 61. The inner and outer collars 64, 68 are spaced to form an annular channel 72. The inner collar 64 is coupled to the vertical support 58 and does not move. The area within the inner collar 64 defines a non-rotating space 69. The input tube 24, air hose 210 and the intensifier shaft 170 (described below) extend through the non-rotating space 69. The end of the non-rotating space 69 opposite the vertical support 58 is closed off by an end plate 67. The end plate 67 includes an air hose opening 65 and an intensifier shaft opening 63. The outer side of the end plate 67 is structured to engage the shell assembly drum plate 34 and, as shown in FIG. 1, includes a semi-circular body 36 having an opening 37. The drum plate opening 37 is covered by a membrane 38 through which the input tube 24 may be inserted.

Figure 7:
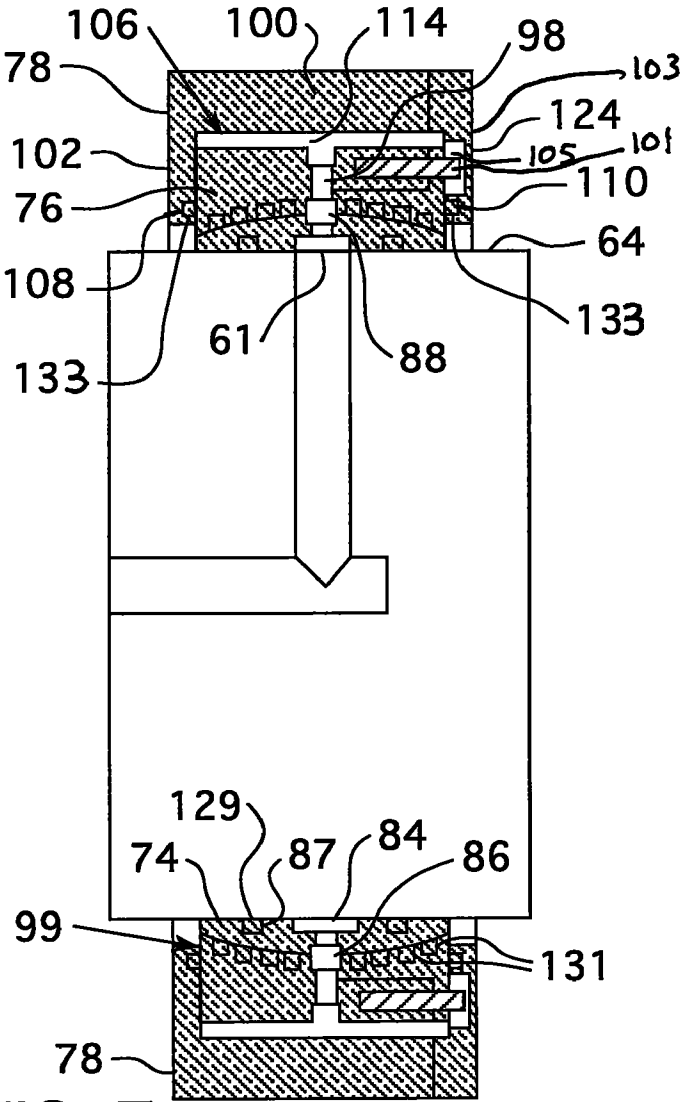
FIG. 7 is a cross-sectional view of a seal assembly taken along line 7-7 in FIG. 5.
Figure 6:
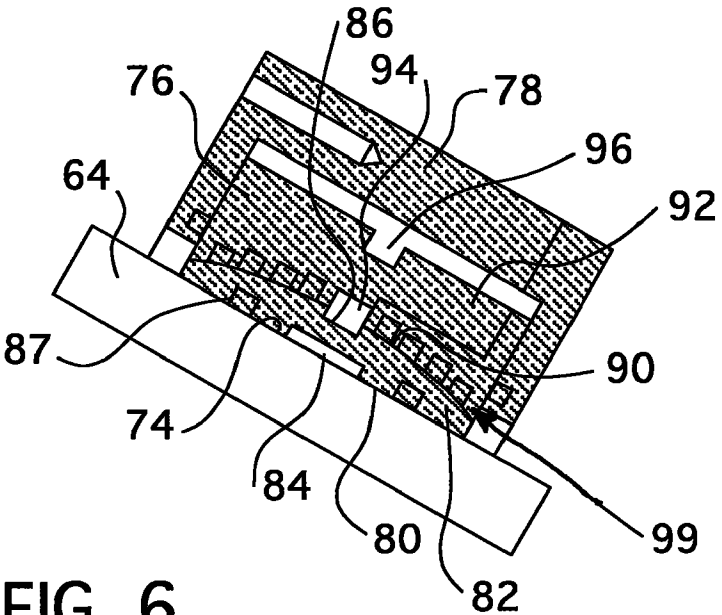
FIG. 6 is a detailed cross-sectional view of a seal assembly taken along line 6-6 in FIG. 5.

The rotating base 62 includes two components, a bearing assembly 71 and drum assembly 120. As shown in FIGS. 6 and 7, the bearing assembly 71 includes an inner bearing 74, a medial bearing 76, and an outer bearing 78. Referring to FIG. 6, the inner bearing 74 is a torus with a cylindrical inner surface 80 and an arced spherical outer surface 82. Both the inner surface 80 and outer surface 82 of the inner bearing 74 include medial air channels 84, 86 which are, essentially, circumferential grooves. The inner bearing inner surface 80 also includes at least one circumferential seal groove 87. At selected locations radial openings 88 extend between the inner bearing medial air channels 84, 86. Referring to FIG. 6, the medial bearing 76 is a torus having a spherical inner surface 90 and a cylindrical outer surface 92. Both the inner surface 90 and outer surface 92 of the medial bearing 76 include medial air channels 94, 96 which are, essentially, circumferential grooves. At selected locations radial openings 98 extend between the medial bearing medial air channels 94, 96. The medial bearing inner surface 90 also includes a plurality of circumferential seal grooves 99. The outer bearing 78 is a torus having a U-shaped cross-section. That is, the outer bearing 78 includes a hollow cylindrical body 100 having inwardly extending ridges 102, 104 at each end. The inwardly extending ridges 102, 104 form a channel 106. The outer bearing inwardly extending ridges 102, 104 are sized to fit tightly about the medial bearing 76 and include circumferential seal grooves 108, 110. The outer bearing 78 also includes a plurality of fastener openings 119 which extend generally parallel to the axis of the outer bearing 78.

The seal assembly 71 is assembled as follows. The inner bearing 74 is disposed on the fixed base inner collar 64 with the inner bearing inner surface 80 engaging the inner collar outer surface 66 and the inner bearing inner medial air channel 84 aligned with the air supply tube opening 61. Seals 129 are disposed in each inner bearing inner surface seal groove 87. The medial bearing 76 is disposed on the inner bearing 74 with the medial bearing spherical inner surface 90 engaging the inner bearing spherical outer surface 82. Seals 131 are disposed in each medial bearing inner surface seal groove 99. The outer bearing 78 is coupled to the medial bearing 76 by a plurality of bearing pins 101. The medial bearing 76 includes a plurality of pin openings 103 which are, preferably, generally round, axial holes in the medial bearing 76. The outer bearing 78 includes a plurality of radial slots 105 in body 100. The slots 105 are each aligned with a pin opening 103. The slots 105 are sized to allow the outer bearing 78 to articulate relative to the medial bearing 76. Thus, the slots 105 extend radially inward and outward from the pin openings 103, but are further sized with a width that generally corresponds to the diameter of the bearing pins 101.

Seals 133 are disposed in the circumferential seal grooves 108, 110 on each side of the medial bearing 76. The shell assembly mounting plate 122 is coupled to the medial bearing 76 with a gap 114 between the medial bearing outer surface 92 and the shell assembly mounting plate cylindrical body 100. It is noted that in this configuration the inner bearing medial air channels 84, 86, inner bearing radial openings 88, medial bearing medial air channels 94, 96, medial bearing radial openings 98 and the gap 114 are in fluid communication.

The drum assembly 120 includes a shell assembly mounting plate 122, a motor drum 124, and an X-type bearing 126. The shell assembly mounting plate 122 is a disk 128 having a central opening 130 and a plurality of medial, annular fastener openings 132. That is, the fastener openings 132 are located between the central opening 130 and the outer edge of the disk 128. The shell assembly mounting plate fastener openings 132 are aligned with the outer bearing fastener openings 119. The motor drum 124 is a hollow cylinder 134 with an inner diameter that is just larger than the outer collar outer surface 70. The motor drum 124 outer surface includes a belt track 135 that is structured to be engaged by a drive belt 19 (shown in FIGS. 3 and 4). The motor drum 124 is coupled at one edge to the shell assembly mounting plate 122 thereby forming a generally cup-shaped component.

Figure 9:
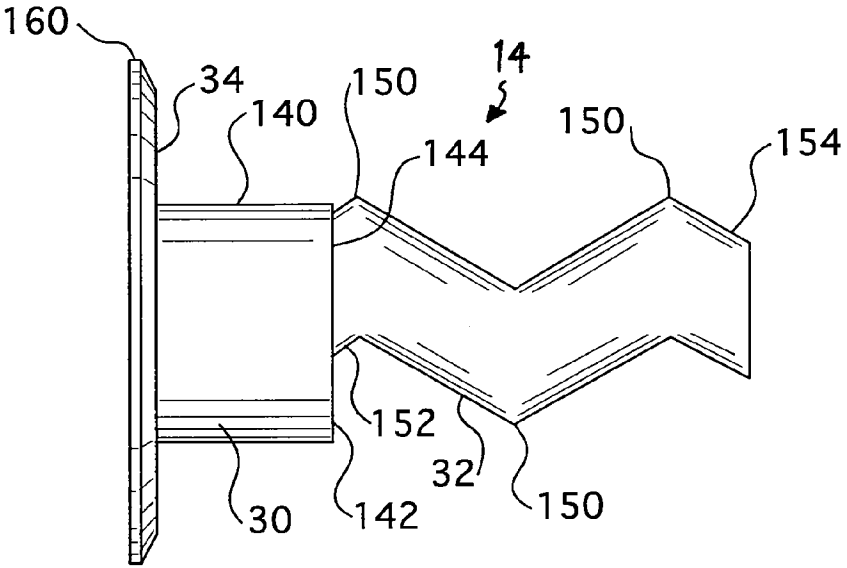
FIG. 9 is a side view of the shell assembly.
Figure 11:
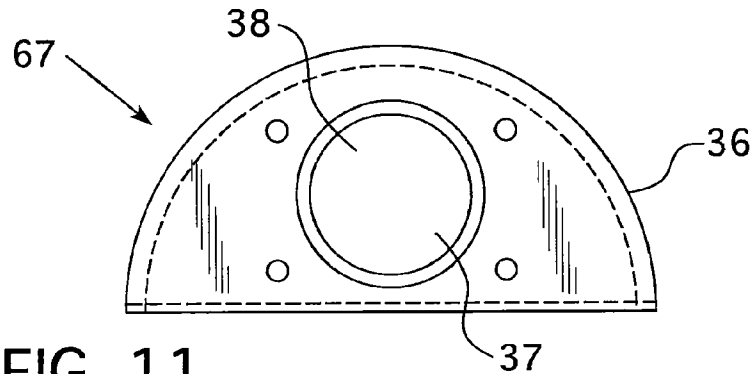
FIG. 11 is a detail view of an end plate.

When the rotating base 62 is assembled, the drum assembly 120 is coupled to the seal assembly 71 by fasteners 136 that extend through the shell assembly mounting plate fastener openings 132 and into the outer bearing fastener openings 119. When the seal assembly 71 is disposed on the fixed base inner collar 64, the motor drum 124 is adjacent to the outer collar outer surface 70. The X-type bearing 126 is disposed between the motor drum 124 and the outer collar outer surface 70. As noted above, and as shown in FIG. 9, the shell assembly 14 includes an intensifier chamber 30, a zig-zag tube 32, and a drum plate 34. The intensifier chamber 30 includes a cylindrical side wall 140 and a generally perpendicular end plate 142. The intensifier chamber end plate 142 includes an off-center opening 144. The zig-zag tube 32 includes a plurality of V-shaped sections 150, three as shown, which are in the same general plane. A first end 152 of the zig-zag tube 32 is coupled to the intensifier chamber end plate 142 and extends about the intensifier chamber end plate opening 144. As such, the intensifier chamber 30 is in communication with the zig-zag tube 32. A second end 154 of the zig-zag tube 32 is open and is the discharge location of the mixed material. It is noted that the present invention contemplates having multiple shell assemblies 14 with various sized intensifier chambers 30 and zig-zag tubes 32, some examples of which are described below. That is, the intensifier chambers 30 and zig-zag tubes 32 would have various lengths and diameters as required for various mixed products. Additionally, the angles of the V-shaped sections 150 may be acute or obtuse as required by the mixture. The different shell assemblies 14 may be quickly swapped as described below.

The intensifier chamber side wall 140 is coupled to the drum plate 34. The drum plate 34 includes a disk 160 that has the same diameter as the shell assembly mounting plate 122. The drum plate 34, and therefore the shell assembly 14, is coupled to the shell assembly mounting plate 122 by a plurality of clamps 162, such as, but not limited to, manual sanitary clamps. Because the clamps 162 are easily removed, the shell assembly 14 is removably coupled to the drive unit assembly 12.

Figure 8:
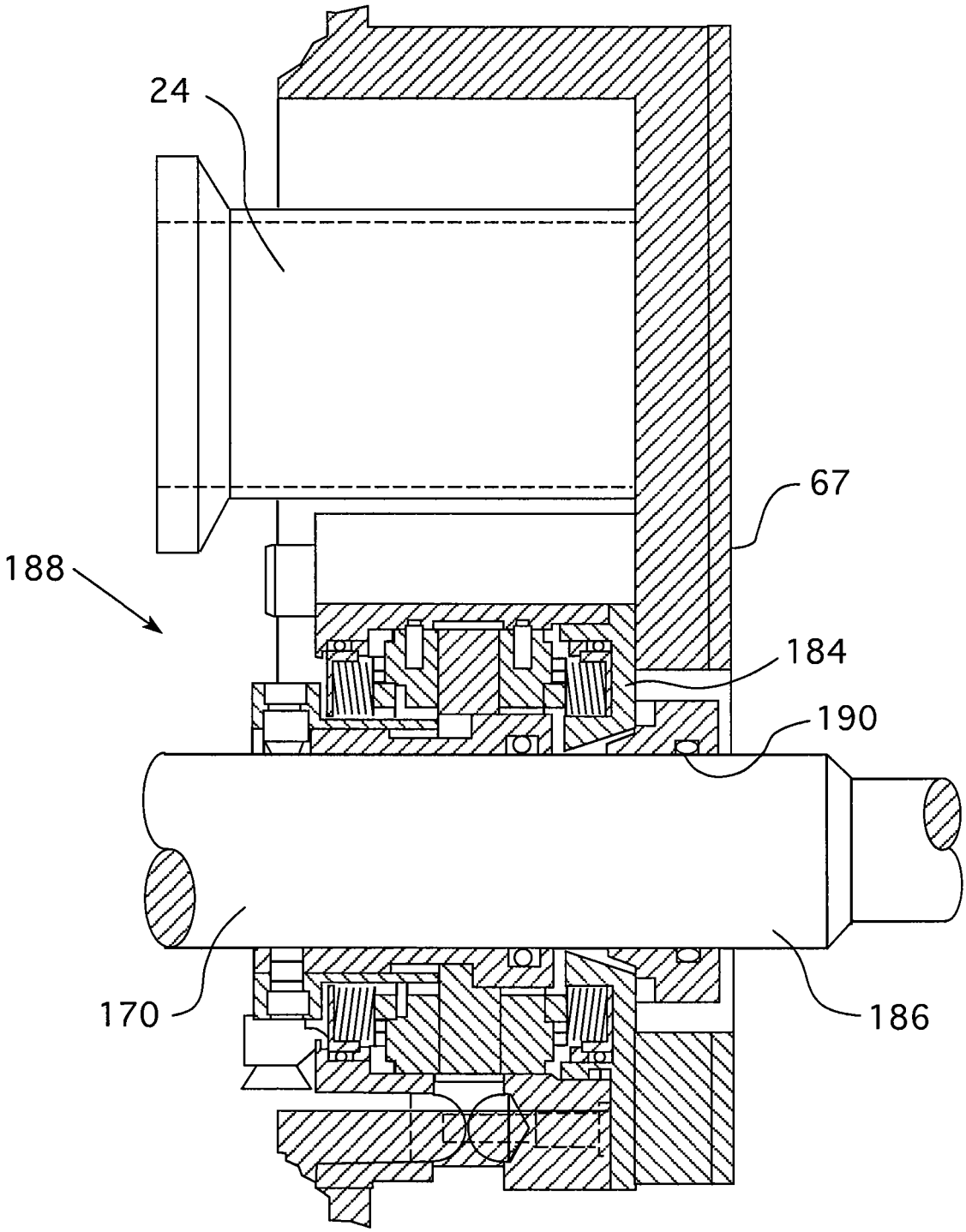
FIG. 8 is a detailed cross-sectional view of an intensifier seal assembly.

The intensifier assembly 20 includes a shaft 170, an intensifier motor 171, a shaft support assembly 172, a seal assembly 174 and one or more paddles 176. The intensifier shaft 170 may be hollow and coupled to a liquid supply. The intensifier shaft 170 includes a belt track 178 that is structured to be engaged by a drive belt 200. The shaft support assembly 172 is coupled to the vertical support 58 and includes two or more yokes 180, 182 structured to support the intensifier shaft 170 in a generally horizontal orientation. The seal assembly 174 includes a housing 184 (shown in FIG. 8) that is disposed in the non-rotating space 69 and coupled to the end plate 67 at the intensifier shaft opening 63. The seal assembly housing 184 includes an opening 186 that is in communication with the end plate intensifier shaft opening 63. The intensifier shaft 170 passes through the seal assembly housing 184 and the intensifier shaft opening 63 thereby extending outwardly from the non-rotating space 69. When a shell assembly 14 is coupled to the drive unit assembly 12, the intensifier shaft 170 extends into the intensifier chamber 30. The seal assembly housing 184 further includes a shaft passage 188. The shaft passage 188 includes a plurality of seals 190 disposed between the intensifier shaft 170 and the shaft passage 188. The shaft passage 188 is further coupled to the air supply assembly 25 so that the shaft passage 188 may be air purged. The intensifier paddles 176 are disposed at the end of the intensifier shaft 170 that extends into the intensifier chamber 30.

The intensifier motor 171 is coupled to the mounting plate 40. The intensifier motor 171 includes a drive belt 200 structured to engage the intensifier shaft belt track 178. When the intensifier motor 171 is operated, the intensifier motor drive belt 200 imparts a rotational motion to the intensifier shaft 170. The intensifier motor 171 is structured to be operated at various speeds, intermittently, and in reverse. The intensifier motor 171 is further adapted to be controlled by the control device 22.

The air supply assembly 25 includes an air hose 210 that is coupled to a pressurized air supply (not shown). The air hose 210 is coupled to, and in fluid communication with, the shaft passage 188 and the air hose opening 65 within the non-rotating space 69. Thus, the air supply assembly 25 acts to provide an air purge to the shaft passage 188 and the combination of the inner bearing medial air channels 84, 86, inner bearing radial openings 88, medial bearing medial air channels 94, 96, medial bearing radial openings 98 and the gap 114.

The shell motor 18 is coupled to the mounting plate 40. The shell motor 18 includes a drive belt 19 structured to engage the motor drum outer surface belt track 135. When the shell motor 18 is operated, the shell motor drive belt 19 imparts a rotational motion to the shell assembly 14. The shell motor 18 is structured to be operated at various speeds, intermittently, and in reverse. The shell motor 18 is further adapted to be controlled by the control device 22.

Figure 10:
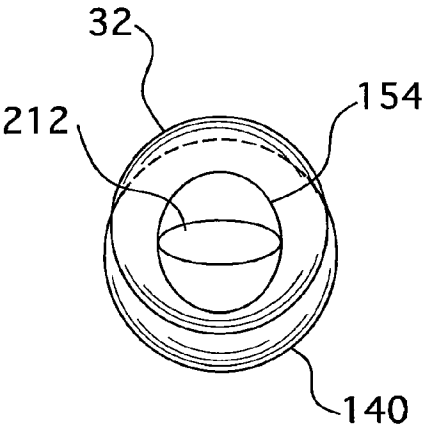
FIG. 10 is an end view of the shell assembly.

The input tube 24 extends generally horizontally through the housing assembly 16. The input tube 24 extends through the non-rotating space 69 and, when a shell assembly 14 is coupled to the drive unit assembly 12, opens into the intensifier chamber 30. The input tube 24 includes a screw 23 structured to rotate in a direction so that a material within the input tube 24 moves toward the shell assembly 14. Thus, when the metering devices 2 repeatedly eject a measured amount of a powdered material into the input tube 24, the screw 23 moved the powdered material into the shell assembly 14. Alternatively, the end metering device 5 includes an extension 213 which extends into the zig-zag tube second end 154 and past the vertex of the last V-shaped section 150. As shown in FIG. 10, the angles and diameter of the zig-zag tube 32 are, preferably, sized so that a generally straight passage 212 extends from the second end 154 and past the vertex of the last V-shaped section 150. As such, a powdered material may also be introduced near the discharge location.

The control device 22 includes a programmable device such as, but not limited to, a programmable logic circuit. The control device 22 may be programmed with the parameters of various mixing procedures, e.g., motor speeds and the degree of tilt for the mounting plate 40. The control device 22 controls the shell motor 18, the intensifier motor 171, and the adjustable mount upper component 54. When a user selects the desired routine, the control device 22 will set the adjustable mount upper component 54 at the proper height for the desire tilt, and control the shell motor 18 and the intensifier motor 171 to operate at the desired speeds, intermittently, duration or in reverse. For applications where a sensor or instrument is/are used to measure the blend result at the output of the blender, the control device 22 can also be programmed for close-loop control. The blend result is feed back into the control device 22 as input signal, and the control device 22 will vary the mixing procedures to achieve or maintain the desired blend result.

In this configuration, a user may quickly adapt the continuous blender 10 for use in blending different mixtures. The user selects a first shell assembly 14 with the desired size and couples the first shell assembly 14 to the drive unit assembly 12 using the clamps 162. The user then utilizes the control device 22 to select the desired operating parameters for the shell motor 18 and the intensifier motor 171 as well as the desired tilt of the mounting plate 40. When the continuous blender 10 is needed to create another mixture, the user removes the first shell assembly 14 and selects a second shell assembly 14. The user then utilizes the control device 22 and selects a different set of operating parameters for the shell motor 18 and the intensifier motor 171 as well as the desired tilt of the mounting plate 40

Figure 12:
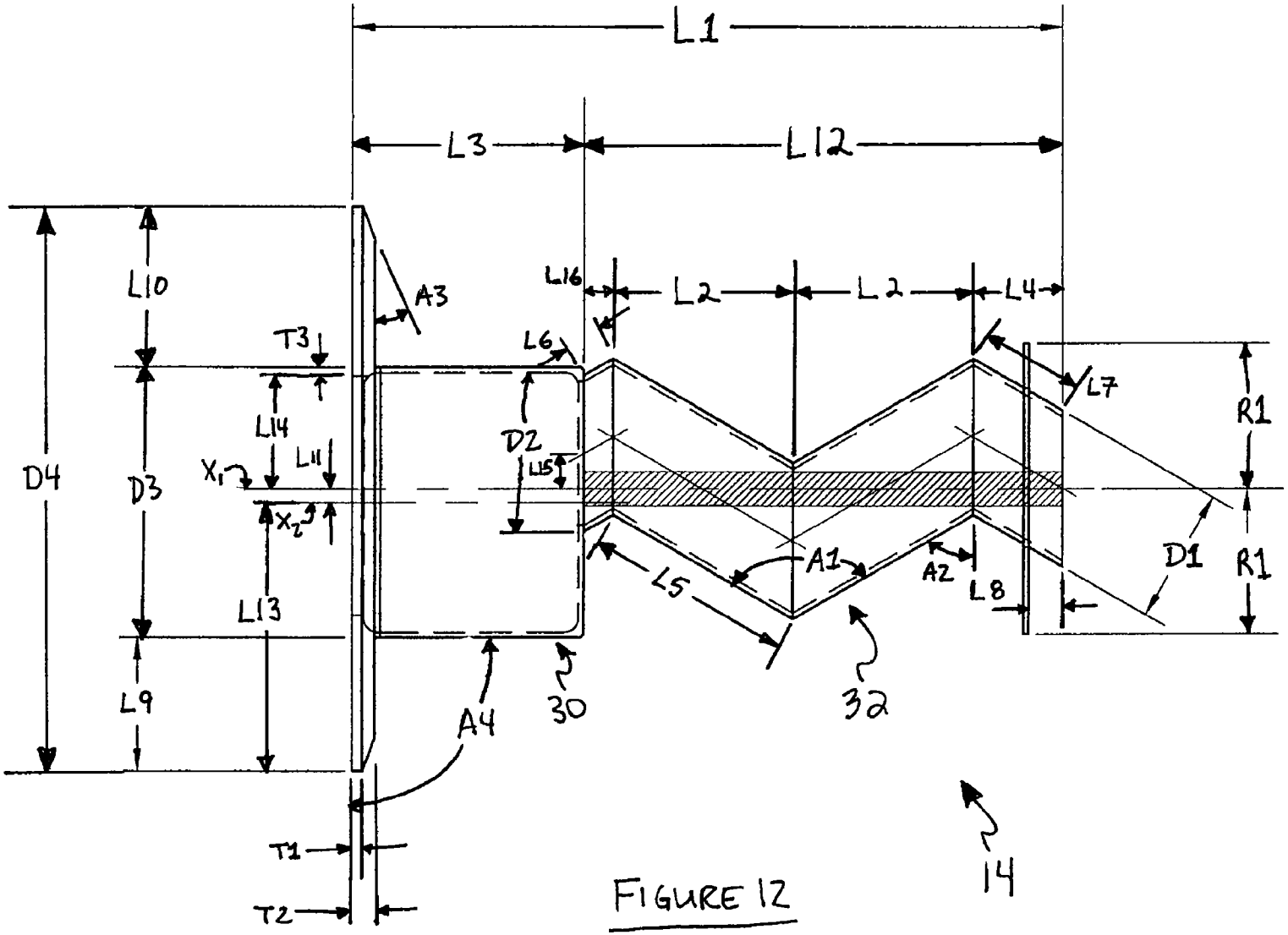
FIG. 12 is a cross-sectional view of a shell assembly in accordance with an embodiment of the present invention.

Some example shell assemblies 14 in accordance with the present invention will now be described. Such examples are not meant to limit the scope of the present invention. Table 1 below in conjunction with FIG. 12 provides dimensions of a first exemplary shell assembly 14, in accordance with the present invention, that may provide for a throughput of approximately 5-30 kg/hour for a product with a specific gravity of about 0.5-0.6 (31-37 lb/cu. ft. density). In FIG. 12, X1 denotes the rotational centerline of the shell assembly 14 and X2 denotes the centerline of the intensifier chamber 30.

TABLE 1

| Identifier | Value (inches) |
|---|---|
| L1 | 15¾ |
| L2 | 4 |
| L3 | 5⅛ |
| L4 | 2 |
| L5 | 4⅝ |
| L6 | 23/32 |
| L7 | 2 9/32 |
| L8 | ¾ |
| L9 | 3 |
| L10 | 3⅝ |
| L11 | 5/16 |
| L12 | 10⅝ |
| L13 | 5 63/64 |
| L14 | 2½ |
| L15 | 25/32 |
| L16 | ⅝ |
| D1 | 3 |
| D2 | 3 15/32 |
| D3 | 6 |
| D4 | 12.571 |
| T1 | 7/32 |
| T2 | ½ |
| T3 | ⅛ |
| R1 | 3 15/64 |
| A1 | 120 degrees |
| A2 | 60 degrees |
| A3 | 20.5 degrees |
| A4 | 90 degrees |

Table 2 below in conjunction with FIG. 12 provides dimensions of a second exemplary shell assembly, in accordance with the present invention, that may provide for a throughput of approximately 30-90 kg/hour for a product with a specific gravity of about 0.5-0.6 (31-37 lb/cu. ft. density).

TABLE 2

| Identifier | Value (inches) |
|---|---|
| L1 | 21 3/32 |
| L2 | 5 9/32 |
| L3 | 6 15/16 |
| L4 | 2¾ |
| L5 | 6 3/32 |
| L6 | 31/32 |
| L7 | 3 3/16 |
| L8 | 1 |
| L9 | 1⅞ |
| L10 | 2 11/16 |
| L11 | 13/32 |
| L12 | 14 5/32 |
| L13 | |
| L14 | |
| L15 | 1 1/32 |
| L16 | 27/32 |
| D1 | 4 |
| D2 | 4⅝ |
| D3 | 8 |
| D4 | 12.571 |
| T1 | 7/32 |
| T2 | ½ |
| T3 | ⅛ |
| R1 | 3 57/64 |
| A1 | 120 degrees |
| A2 | 60 degrees |
| A3 | 20.5 degrees |
| A4 | 90 degrees |

Table 3 below in conjunction with FIG. 12 provides dimensions of a third exemplary shell assembly, in accordance with the present invention, that may provide for a throughput of approximately 90-150 kg/hour for a product with a specific gravity of about 0.5-0.6 (31-37 lb/cu. ft. density).

TABLE 3

| Identifier | Value (inches) |
|---|---|
| L1 | 30⅞ |
| L2 | 8 |
| L3 | 10½ |
| L4 | 4¼ |
| L5 | |
| L6 | |
| L7 | |
| L8 | 1 |
| L9 | |
| L10 | |
| L11 | ⅝ |
| L12 | 20⅜ |
| L13 | |
| L14 | |
| L15 | |
| L16 | |
| D1 | 6 |
| D2 | |
| D3 | 12 |
| D4 | 12.571 |
| T1 | 7/32 |
| T2 | ½ |
| T3 | ⅛ |
| R1 | 6 |
| A1 | 120 degrees |
| A2 | 60 degrees |
| A3 | 20.5 degrees |
| A4 | 90 degrees |

It may be appreciated that such example shell assemblies may be readily exchanged as described above. It is also to be appreciated that such example assemblies may be provided as a kit accompanying the continuous blender mechanism.

Thus, a user is able to change the throughput rate of the mixed material by exchanging the shell assemblies 14. That is, a user may operate the continuous blender with a first shell assembly having a first throughput, subsequently remove the first shell assembly and install a second shell assembly having a second throughput different from said first throughput, and then operate the continuous blender with the second shell assembly. Additionally, a user may then remove the second shell assembly and install a third shell assembly having a third throughput different from the first throughput and the second throughput, and then operate the continuous blender with the third shell assembly.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A kit for use with an adjustable continuous blender in blending a product, the continuous blender comprising: a drive unit assembly having a shell assembly plate structured to be coupled to a shell assembly; at least one clamp structured to removably couple said shell assembly to said drive unit assembly; said kit comprising:

a first shell assembly having a first throughput; and a second shell assembly having a second throughput, wherein said second through throughput is different from said first throughput;

wherein each shell assembly is structured to be removably coupled to said drive unit assembly and each shell assembly includes an intensifier chamber and a cantilever zig-zag tubular member.

2. The kit of claim 1, wherein the continuous blender contains a product having a specific gravity of about 0.5 to 0.6, and the first shell assembly is structured to blend the product such that the first throughput is generally between 5 kg/hour and 30 kg/hour, and the second shell assembly is structured to blend the product such that the second throughput is generally between 30 kg/hour and 90 kg/hour.

3. The kit of claim 1, wherein the continuous blender contains a product having a specific gravity of about 0.5 to 0.6, and the first shell assembly is structured to blend the product such that the first throughput is generally between 5 kg/hour and 30 kg/hour, and the second shell assembly is structured to blend the product such that the second throughput is generally between 90 kg/hour and 150 kg/hour.

4. The kit of claim 1, wherein the continuous blender contains a product having a specific gravity of about 0.5 to 0.6, and the first shell assembly is structured to blend the product such that the first throughput is generally between 30 kg/hour and 90 kg/hour, and the second shell assembly is structured to blend the product such that the second throughput is generally between 90 kg/hour and 150 kg/hour.

5. The kit of claim 1, further comprising a third shell assembly having a third throughput, wherein said third throughput is different from said first throughput and said second throughput.

6. The kit of claim 5, wherein the continuous blender contains a product having a specific gravity of about 0.5 to 0.6, and the first shell assembly is structured to blend the product such that the first throughput is generally between 5 kg/hour and 30 kg/hour, the second shell assembly is structured to blend the product such that the second throughput is generally between 30 kg/hour and 90 kg/hour, and the third shell assembly is structured to blend the product such that the third throughput is generally between 90 kg/hour and 150 kg/hour.

7. A method of operating a continuous blender using the kit of claim 1 said shell assembly having an intensifier chamber and a cantilever zig-zag tubular member; said method comprising:

operating said continuous blender with said first shell assembly having said first throughput;

removing said first shell assembly;

installing said second shell assembly having said second throughput different from said first throughput; and operating said continuous blender with said second shell assembly.

8. The method of claim 7, wherein, when the product has a specific gravity of about 0.5 to 0.6:

the first shell assembly is structured to blend the product such that the first throughput is generally between 5 kg/hour and 30 kg/hour, and the second shell assembly is structured to blend the product such that the second throughput is generally between 30 kg/hour and 90 kg/hour.

9. The method of claim 7, wherein, when the product has a specific gravity of about 0.5 to 0.6:

the first shell assembly is structured to blend the product such that the first throughput is generally between 5 kg/hour and 30 kg/hour, and the second shell assembly is structured to blend the product such that the second throughput is generally between 90 kg/hour and 150 kg/hour.

10. The method of claim 7, wherein, when the product has a specific gravity of about 0.5 to 0.6:

the first shell assembly is structured to blend the product such that the first throughput is generally between 30 kg/hour and 90 kg/hour; and the second shell assembly is structured to blend the product such that the second throughput is generally between 90 kg/hour and 150 kg/hour.

11. The method of claim 7, wherein, when the product has a specific gravity of about 0.5 to 0.6:

the first shell assembly is structured to blend the product such that the first throughput is generally between 90 kg/hour and 150 kg/hour, and the second shell assembly is structured to blend the product such that the second throughput is generally between 30 kg/hour and 90 kg/hour.

12. The method of claim 7, wherein, when the product has a specific gravity of about 0.5 to 0.6:

the first shell assembly is structured to blend the product such that the first throughput is generally between 90 kg/hour and 150 kg/hour, and the second shell assembly is structured to blend the product such that the second throughput is generally between 5 kg/hour and 30 kg/hour.

13. The method of claim 7, wherein, when the product has a specific gravity of about 0.5 to 0.6:

the first shell assembly is structured to blend the product such that the first throughput is generally between 30 kg/hour and 90 kg/hour, and the second shell assembly is structured to blend the product such that the second throughput is generally between 5 kg/hour and 30 kg/hour.

14. The method of claim 7, further comprising removing said second shell assembly; installing a third shell assembly having a third throughput different from said first throughput and said second throughput; and operating said continuous blender with said third shell assembly.

* * * * *